US007695412B2

(12) United States Patent
Hansard

(10) Patent No.: US 7,695,412 B2
(45) Date of Patent: Apr. 13, 2010

(54) PORTABLE ATTACHMENT DEVICE AND METHOD FOR COMFORT AND SUPPORT

(76) Inventor: Phil Hansard, 4680 Browns Bridge Rd., Cumming, GA (US) 30041

( * ) Notice: Subject to any disclaimer, the term of this patent is extended or adjusted under 35 U.S.C. 154(b) by 0 days.

(21) Appl. No.: 12/463,294

(22) Filed: May 8, 2009

(65) Prior Publication Data

US 2009/0215590 A1 Aug. 27, 2009

Related U.S. Application Data

(62) Division of application No. 11/438,597, filed on May 22, 2006, now abandoned.

(51) Int. Cl.
*A63B 25/00* (2006.01)

(52) U.S. Cl. ..... 482/75

(58) Field of Classification Search ..... 482/75, 482/76, 105, 79–80; 623/28
See application file for complete search history.

(56) References Cited

U.S. PATENT DOCUMENTS

| | | | | |
|---|---|---|---|---|
| 433,365 | A | 7/1890 | Pitman | |
| 514,600 | A | 2/1894 | Johnson | |
| 1,613,535 | A | 1/1927 | Root | |
| 2,802,217 | A | 4/1957 | wilhoyte | |
| 2,832,079 | A | 4/1958 | Bailey | |
| 3,058,120 | A | 10/1962 | Smith et al. | |
| 3,102,272 | A | 9/1963 | Emmert | |
| 3,626,519 | A | 12/1971 | Baker | |
| 3,877,426 | A * | 4/1975 | Nirschl | 602/62 |
| 4,415,063 | A | 11/1983 | Hutchison | |
| 4,449,256 | A | 5/1984 | Prueitt | |
| 4,964,401 | A * | 10/1990 | Taigen | 482/93 |
| 5,295,932 | A | 3/1994 | Rowan | |
| 5,316,022 | A * | 5/1994 | Schiek, Sr. | 128/876 |
| 5,344,373 | A * | 9/1994 | Greene | 482/55 |
| 5,514,054 | A | 5/1996 | Rowan | |
| 5,645,515 | A * | 7/1997 | Armstrong et al. | 482/75 |
| 5,868,652 | A * | 2/1999 | Spletzer | 482/105 |
| 6,085,765 | A * | 7/2000 | Sigsworth | 135/68 |
| 6,126,639 | A * | 10/2000 | Sutherland et al. | 604/179 |
| 6,517,586 | B2 | 2/2003 | Lin | |

(Continued)

FOREIGN PATENT DOCUMENTS

| | | |
|---|---|---|
| WO | WO8501219 A1 | 3/1985 |

*Primary Examiner*—Fenn C Mathew
(74) *Attorney, Agent, or Firm*—Clements Bernard PLLC; Lawrence A. Baratta, Jr.; Christopher L. Bernard

(57) ABSTRACT

The present invention provides a system and a method for a portable attachment device. The portable attachment device includes a narrow attachment end, a wide wrap end, a fastening means on the narrow attachment end, a fastening means on the wide wrap end, and padding located within the wide wrap end. The portable attachment device is attachable to a first item by wrapping the narrow attachment end around a portion of the first item and attaching the narrow attachment end to a portion of the wide wrap end, securing the portable attachment device to the item. The first item is then attachable to a second item by wrapping the wide wrap end of the attachment device around the second item. In one embodiment the portable attachment device is used to secure the leg and calf of a wearer to a construction stilt, securely and comfortably holding the leg in place.

10 Claims, 5 Drawing Sheets

U.S. PATENT DOCUMENTS 6,648,803 B1 11/2003 Jay
6,711,750 B1 * 3/2004 Yoo ..... 2/338
7,108,640 B2 * 9/2006 Emmert ..... 482/75
7,204,262 B2 * 4/2007 DeMay et al. ..... 135/68
2003/0203793 A1 10/2003 Emmert
2004/0055076 A1 * 3/2004 Yoo ..... 2/338

* cited by examiner

PORTABLE ATTACHMENT DEVICE AND METHOD FOR COMFORT AND SUPPORT

CROSS-REFERENCE TO RELATED APPLICATION(S)

This application is a divisional of U.S. patent application Ser. No. 11/438,597 filed May 22, 2006 now abandoned, and entitled "PORTABLE ATTACHMENT DEVICE AND METHOD FOR COMFORT AND SUPPORT,"the contents of which are incorporated in full by reference herein.

FIELD OF THE INVENTION

The present invention relates generally to the fields of attachment devices and methods. More specifically, the present invention relates to a portable attachment device and method for removably attaching and comfortably securing the calf portions of the legs of a user's body to construction stilts or the like.

BACKGROUND OF THE INVENTION

Construction stilts are leg-extension devices that advantageously allow the wearer to work and maneuver at an increased height above a floor or other base surface. Such stilts are often used in the construction industry. Construction stilts are helpful, for example, to those persons installing ceilings who need additional height to hold a drywall board in place while at the same time securing the drywall board to the woodwork material behind it. Many construction stilts provide an additional eighteen to forty inches in height to the wearer.

Many of the attachment devices used in construction stilts, connecting the legs of the user to the stilt frames, are rigid, uncomfortable, and cumbersome to wear. In the interest of comfort and safety, there is a need for an improved attachment device for use with construction stilts.

These and other problems exist. Previous attempts to solve these and other problems include the following:

U.S. Pat. No. 6,648,803, issued to Jay on Nov. 18, 2003 discloses a stilt having a multiple-articulating, three segment base, providing enhanced stability and a better translation of walking forces. The stilt disclosed uses a calf band and a removable calf pad.

U.S. Patent Application Publication No. 2003/0203793 A1, filed by Emmert and published on Oct. 30, 2003, discloses a stilt device for supporting a user above a base support surface. The stilt device includes a shoe plate, a base member and at least one intermediary strut. A leg attachment assembly comprises an elongated support pole which extends upwardly from the strut. In some embodiments, a clam-shell assembly is attached to a distal end of the support pole and comprises opposing, curved inner and outer plates configured to surround and support the user's leg. A hinge assembly facilitates rotation of the inner plate with respect to the outer plate between open and closed positions. In other embodiments, a support attachment assembly utilizes a u-shaped bracket and a nested, h-shaped clamp to attach the medial portion of the support pole to the shoe plate. The support attachment assembly establishes and secures both the angular extent and length of the support pole.

U.S. Pat. No. 6,517,586, issued to Lin on Feb. 11, 2003, discloses a support structure having a shoe platform and a floor platform, with the said shoe platform and floor platform movably conjoined, and retained by a sprung component, to a set of supports. Moreover, there are a plurality of leg section supports that are coupled to one of the supports by means of a pivot sleeve having an axial hole and a locating mount. Movably conjoined between the leg section supports is an adjustable calf harness consisting of two adjoined fittings. The shoe platform includes heel rest consisting of a stop mount and a slide mount having selectable position mounting holes. Disposed on the shoe platform are clasp mounts for the positioning of toe straps and strap fastener as well as ankle straps and strap fasteners into shoe platform clasp slots.

U.S. Pat. No. 5,645,515, issued to Armstrong et al. on Jul. 8, 1997, discloses an improved spring-loaded parallelogram stilt. An improved leg support attachment is provided in which the leg support is attached by a capturing bracket to the rearward vertical support. Improved straps are also provided, made of a suitable belt or strap material and have on the surface of the straps or belts hook and loop fastening material. The hook and loop fastening material is arranged on the surface of the straps such that multiple folds of the material create a firm, yet readily adjusted and released, attachment of the straps. This is achieved by having one flap of the strap having loop fastening material on both sides. The remaining surfaces of the strap are covered with hook fastening material. A gap or space is provided between the different fastening material patches so that fold lines are created in which a fastening buckle is engaged. The length of the strap is adjusted using an adjustment buckle.

U.S. Pat. No. 5,514,054, issued to Rowan on May 7, 1996, discloses a pair of stilts, each stilt having a user foot support coupled to an upper leg and to a lower leg. The upper leg is secured to the leg of a user. A foot is coupled to the lower end of the lower leg. The upper leg includes two side members each configured to resist torsional forces and thus to provide stability. Each stilt may include a knee protector mounted to the upper end of the upper leg and arranged to prevent hyperextension of the knee of the user. An adjustable strap with padding is disclosed.

U.S. Pat. No. 5,295,932, issued to Rowan on Mar. 22, 1994, discloses a pair of stilts. Each of the stilts has a resilient flexible foot which can be hinged or integral with the lower stilt leg portion. The resilient flexible foot has first and second projections defining a channel that receives a third projection from the lower stilt portion. The third projection has a horizontal slot to register with vertical slots in the first and second projections. In another embodiment the stilt further includes a shin protector. A height adjustable foam knee protector and an adjustable padded ski-type binding is disclosed.

U.S. Pat. No. 4,449,256, issued to Prueitt on May 22, 1984, discloses a unique arrangement for leg extension jumpers consisting of elastic members connecting movable extension tubes to guide tubes located at the front and rear of a foot platform. The foot platform is pivotally connected at its front to the front guide tube or tubes and at its rear to a support tube or tubes fixed to and extending above the rear guide tube or tubes. A leg strap is fixed to the top of the support tube or tubes. The leg strap is constructed of rigid material with a pad half-way around the leg with the other half being a flexible belt.

U.S. Pat. No. 4,415,063, issued to Hutchison on Nov. 15, 1983, discloses a leg stilt device. The leg stilt device permits the user to safely adjust the height of the stilt while thereon and is stable, holding the user in a level safe position. The device includes one or more pairs of hollow tubular telescoping vertical support members, a horizontal platform secured to the upper end of the uppermost-extending such member, a broad flat horizontal base connected to the lower end of the lowermost extending vertical member of each pair and providing the desired stability, a tubular leg brace connected to and extending above the platform, and a stilt height adjusting mechanism releasably coupling the two vertical members together. An openable leg strap is attached to the brace for releasably securing the leg of the stilt when the wearer's shoe is in the strap.

The following patents also disclose various stilt devices as they have evolved over the last one-hundred-plus years: U.S. Pat. No. 3,626,519, issued to Baker on Dec. 14, 1969; No. 3,102,272 issued to Emmert on Sep. 3, 1963; No. 3,058,120 issued to Smith et al. on Oct. 16, 1962; No. 2,832,079 issued to Bailey on Apr. 29, 1958; No. 2,802,217 issued to Wilhoyte on Apr. 13, 1957; No. 1,613,535 issued to Root on Jan. 4, 1927; No. 514,600 issued to Johnson on Feb. 13, 1894; and No. 433,365 issued to Pitman on Jul. 29, 1890. In each of patents, a similar rigid attachment system is disclosed.

Additionally, there are several products in the construction industry related to construction stilts and leg attachment assemblies. For example, www.All-Wall.com sales a leg band kit available online. The leg band kit includes leg bands with pads, buckles, straps, and laces. Warner Tool Products also sells construction stilts and accessories online at www.warnertool.com.

Thus, in the prior art, many devices have been disclosed for stilts, construction stilts, and various leg attachment mechanisms. However, despite over a hundred-plus years in product evolution of stilt devices, many of these devices still remain rigid, uncomfortable, and cumbersome to wear. Such devices are simply straps and are not designed for comfort. Additionally, such disclosed stilts require the use of cumbersome and time-consuming buckles or fasteners. The bands or straps used for calf support are often very narrow and thus less comfortable and potentially less safe than a wider, thicker band which provides significantly more comfort and stability. Furthermore, the attachment devices known in the prior art for use with such stilts are not quickly and easily removable for adaptability and/or use on other equipment, such as easily removing the attachment device from one construction stilt and using it on another construction stilt of another height adjustment or another type of device altogether.

However, while such devices may be suitable for their particular purposes, they are not suitable for the purposes of the present invention. Therefore, a need exists for the portable attachment device and method of the present invention.

BRIEF SUMMARY OF THE INVENTION

In various embodiments, the present invention includes a portable attachment device that provides both support and comfort. The present invention includes a portable attachment device and method for removably attaching and comfortably securing a first item to a second item.

In one exemplary embodiment of the present invention, the portable attachment device includes a flexible fabric material device having a narrow attachment end and a wide wrap end, wherein the narrow attachment end and the wide wrap end are at opposite ends of the flexible fabric material device, a fastening means on the narrow attachment end, a fastening means on the wide wrap end, and padding located within the wide wrap end. The portable attachment device is attachable to a first item by wrapping the narrow attachment end of the flexible fabric material device around a portion of the first item and attaching the narrow attachment end to a portion of the wide wrap end with the fastening means on the narrow attachment end, securing the portable attachment device to the first item. The first item and the portable attachment device are then attachable to a second item by wrapping the wide wrap end of the attachment device around the second item, securing the portable attachment device and the first item to the second item with the fastening means on the wide wrap end.

In another exemplary embodiment of the present invention, a method for manufacturing a portable attachment device is disclosed. This method includes the steps cutting a first piece of flexible fabric material into a shape having a narrow attachment end and a wide wrap end, cutting a second piece of flexible fabric material into a shape having a narrow attachment end and a wide wrap end, placing padding between portions of two stacked layers of the first piece of flexible fabric material and the second piece of flexible fabric material at the wide wrap end, securing the stacked layers of flexible fabric material and padding together, securing a fastening means to the narrow attachment end, and securing a fastening means to the wide wrap end.

In yet another exemplary embodiment of the present invention, a construction stilt system having a portable attachment device includes a construction stilt, for use on a leg of the wearer, a flexible fabric material device having a narrow attachment end and a wide wrap end, wherein the narrow attachment end and the wide wrap end are at opposite ends of the flexible fabric material device, a fastening means on the narrow attachment end, a fastening means on the wide wrap end, and padding located within the wide wrap end. The portable attachment device is attachable to the construction stilt by wrapping the narrow attachment end of the flexible fabric material device around a portion of the construction stilt and attaching the narrow attachment end to a portion of the wide wrap end with the fastening means on the narrow attachment end, securing the portable attachment device to the construction stilt. The construction stilt and the portable attachment device are then attachable to a leg of the wearer by wrapping the wide wrap end of the attachment device around the leg of the wearer, securing the portable attachment device and the construction stilt to the leg of the wearer of the construction stilt with the fastening means on the wide wrap end.

In still yet another exemplary embodiment of the present invention, a method for manufacturing a construction stilt system having a portable attachment device is disclosed. The method includes cutting a first piece of flexible fabric material into a shape having a narrow attachment end and a wide wrap end, cutting a second piece of flexible fabric material into a shape having a narrow attachment end and a wide wrap end, placing padding between portions of two stacked layers of the first piece of flexible fabric material and the second piece of flexible fabric material at the wide wrap end, securing the stacked layers of flexible fabric material and padding together, securing a fastening means to the narrow attachment end, securing a fastening means to the wide wrap end, and attaching the portable attachment device to a construction stilt by wrapping the narrow attachment end of the flexible fabric material around a portion of the construction stilt and attaching the narrow attachment end to a portion of the wide wrap end with the fastening means on the narrow attachment end, securing the portable attachment device to the first item.

In another exemplary embodiment of the present invention, the narrow attachment end includes a surface of nylon or canvas fabric material and a surface of hook fasteners. The wide wrap end includes a surface of nylon or canvas material, a surface of hook fasteners, and a surface of loop fasteners.

In yet another exemplary embodiment of the present invention, the flexible fabric material includes one or more of flexible canvas fabric or flexible nylon fabric material.

There has thus been outlined, rather broadly, the features of the present invention in order that the detailed description that follows may be better understood, and in order that the present contribution to the art may be better appreciated. There are additional features of the invention that will be described and which will form the subject matter of the claims. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Additional aspects and advantages of the present invention will be apparent from the following detailed description of an exemplary embodiment which is illustrated in the accompanying drawings.

BRIEF DESCRIPTION OF THE DRAWINGS

The present invention is illustrated and described herein with reference to various drawings, in which like reference numerals denote like apparatus components and/or method steps, and in which.

DETAILED DESCRIPTION OF THE INVENTION

Before describing the disclosed embodiments of the present invention in detail, it is to be understood that the invention is not limited in its application to the details of the particular arrangement shown since the invention is capable of other embodiments. Also, the terminology used herein is for the purpose of description and not of limitation.

Figure 1:
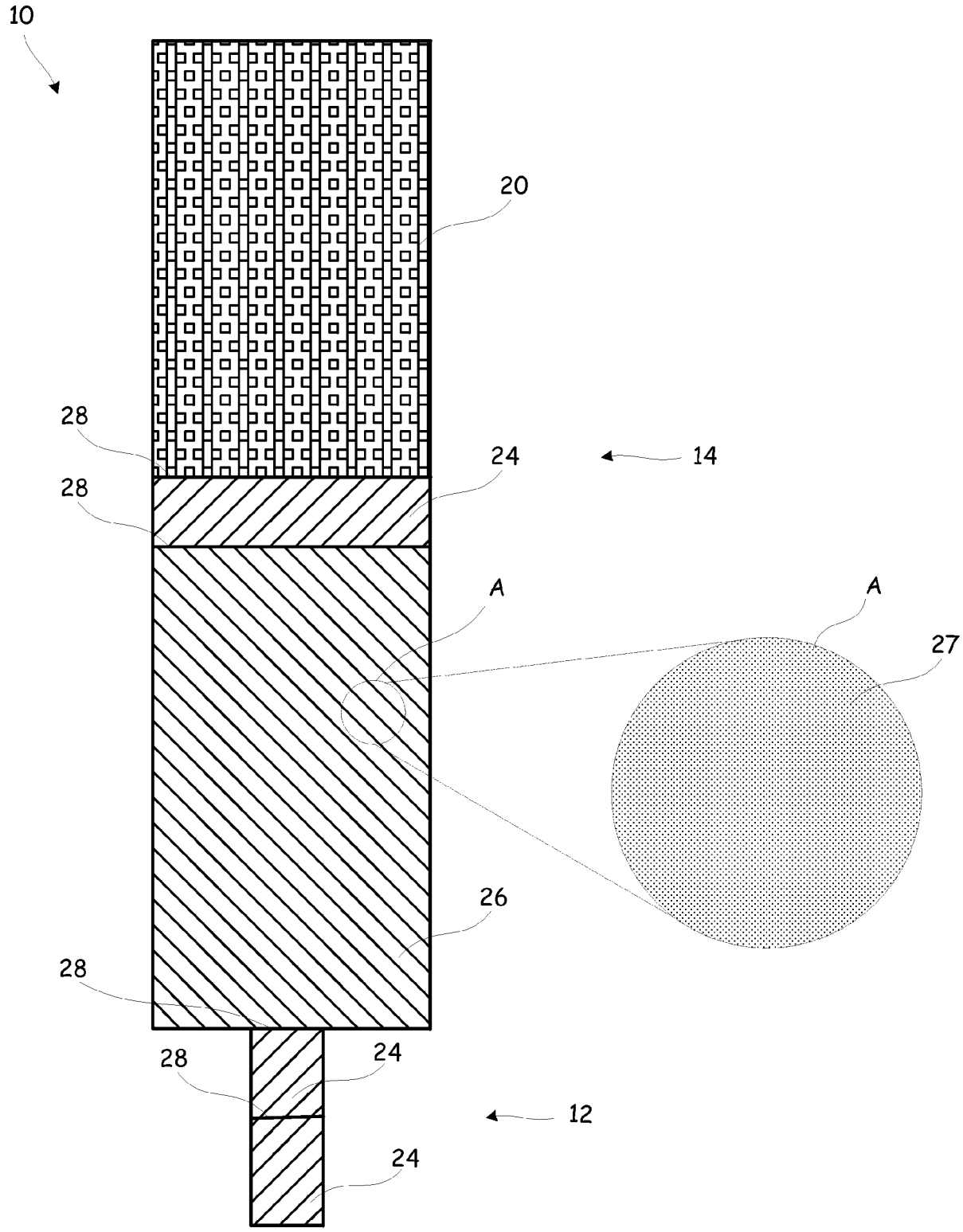
FIG. 1 is an inside planar view of the portable attachment device of the present invention, according to an embodiment of the present invention.
Figure 4:
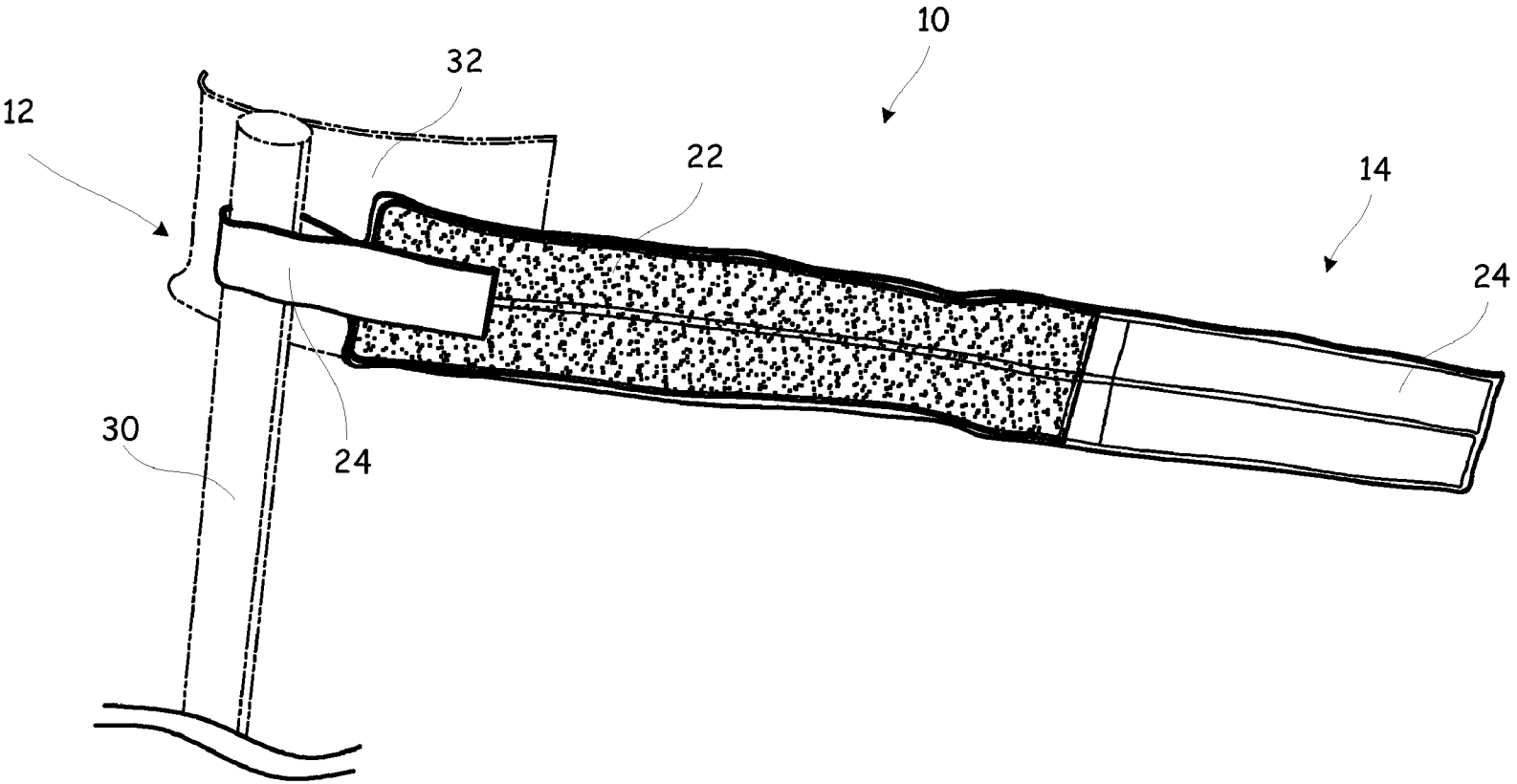
FIG. 4 is a front perspective view of the portable attachment device of the present invention.
Figure 5:
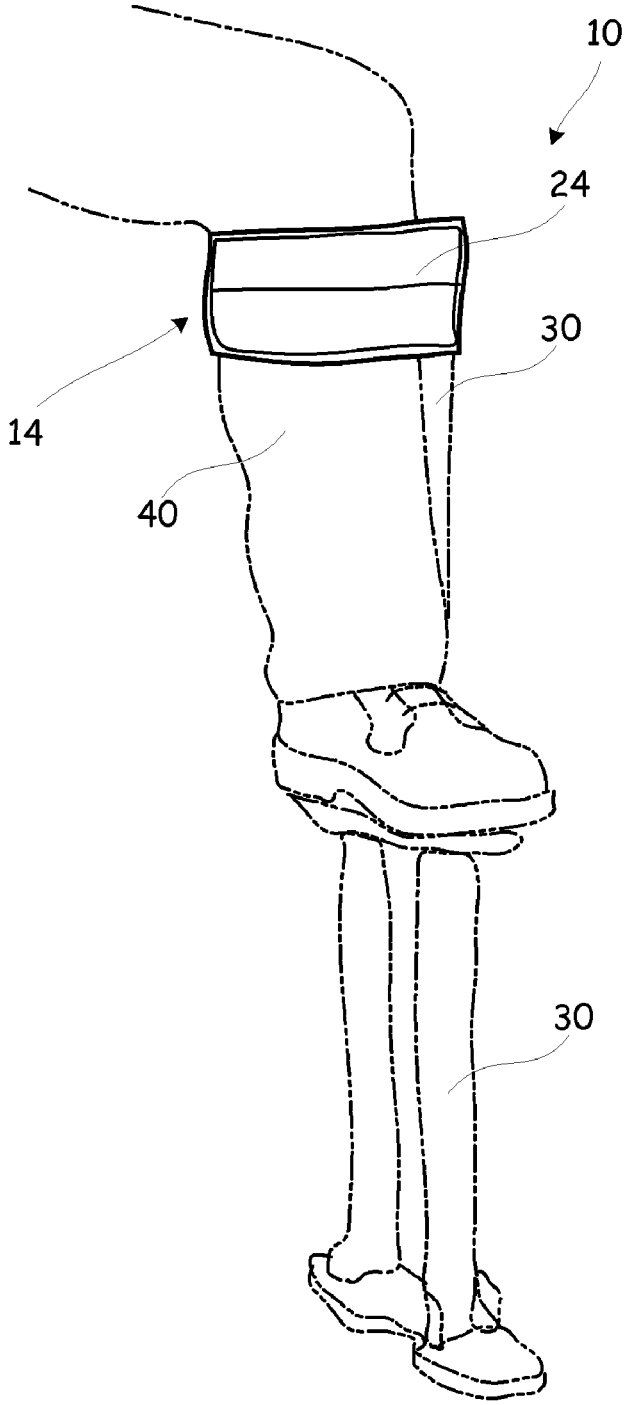
FIG. 5 is a front perspective view of the portable attachment device of the present invention.

Referring now to FIG. 1, an inside planar view of the portable attachment device 10 is shown. This inside view illustrates the inside surfaces (the surfaces that would be placed up against the calf portion of the leg 40 of the wearer, as shown in FIG. 5) of the portable attachment device 10. The portable attachment device 10 is shown with a narrow attachment end 12, and a wide wrap end 14. The narrow attachment end 12 attaches to the stilt frame 30 and leg band 32, as illustrated in FIG. 4. The wide wrap end 14 surrounds the stilt frame 30, leg band 32, and leg 40, as shown in FIGS. 4 and 5, securely and comfortably holding the wearer's leg 40 in place. This inside view illustrates the inside surfaces of the portable attachment device 10. While in use, these surfaces are not visible since they are wrapped on the inside. The wide wrap end 14 includes a surface of hook fasteners 20, a surface of canvas fabric material 24, and a surface of canvas fabric material with padding sewn into it 26. The actual padding 27 is not visible from the outside of the device 10. Reference A depicts a view under the canvas fabric material with padding sewn into it 26 layer and illustrates the padding 27 located inside. The narrow attachment end 12 includes a surface of canvas fabric material 24. Multiple seams 28 are shown illustrating how the various layers of canvas fabric material 24, canvas fabric material with padding sewn into it 26, and hook fasteners 20 are secured together.

The flexible fabric material by which the portable attachment device 10 is manufactured is a canvas fabric material 24; however, like materials such as a nylon, cotton, or the like may also be used. The padding material is a flexible, comfortable material such as foam, cotton, or the like. Various lightweight materials may be used for the padding 27 layer in the wide wrap end 14. Although various combinations of hook and loop fasteners 20, 22 are disclosed in FIG. 1, other types of fasteners may be used. For example, bayonet type fasteners and snap type fasteners (not shown) may also be used to securely hold the various portions of the narrow attachment end 12 and the wide wrap end 14 of the portable attachment device 10 together.

The manufacturing process by which the portable attachment device 10 is constructed includes the following steps: cutting a first piece of flexible fabric material into a shape having a narrow attachment end 12 and a wide wrap end 14, cutting a second piece of flexible fabric material into a shape having a narrow attachment end 12 and a wide wrap end 14, placing padding 27 between portions of two stacked layers of the first piece of flexible fabric material 24 and the second piece of flexible fabric material at the wide wrap end 14, securing the stacked layers and padding 27 together, securing a fastening means 20, 22 to the narrow attachment end 12, and securing a fastening means 20, 22 to the wide wrap end 14.

The manufacturing process by which the portable attachment device 10 is constructed may be varied such that various types of flexible fabric material, fastener types, and attachment methods are used. For example, the various layers of the portable attachment device 10 may be sewn together. Additionally, fastener types such as hook and loop fasteners 20, 22 may be sewn onto the portable attachment device 10.

Figure 2:
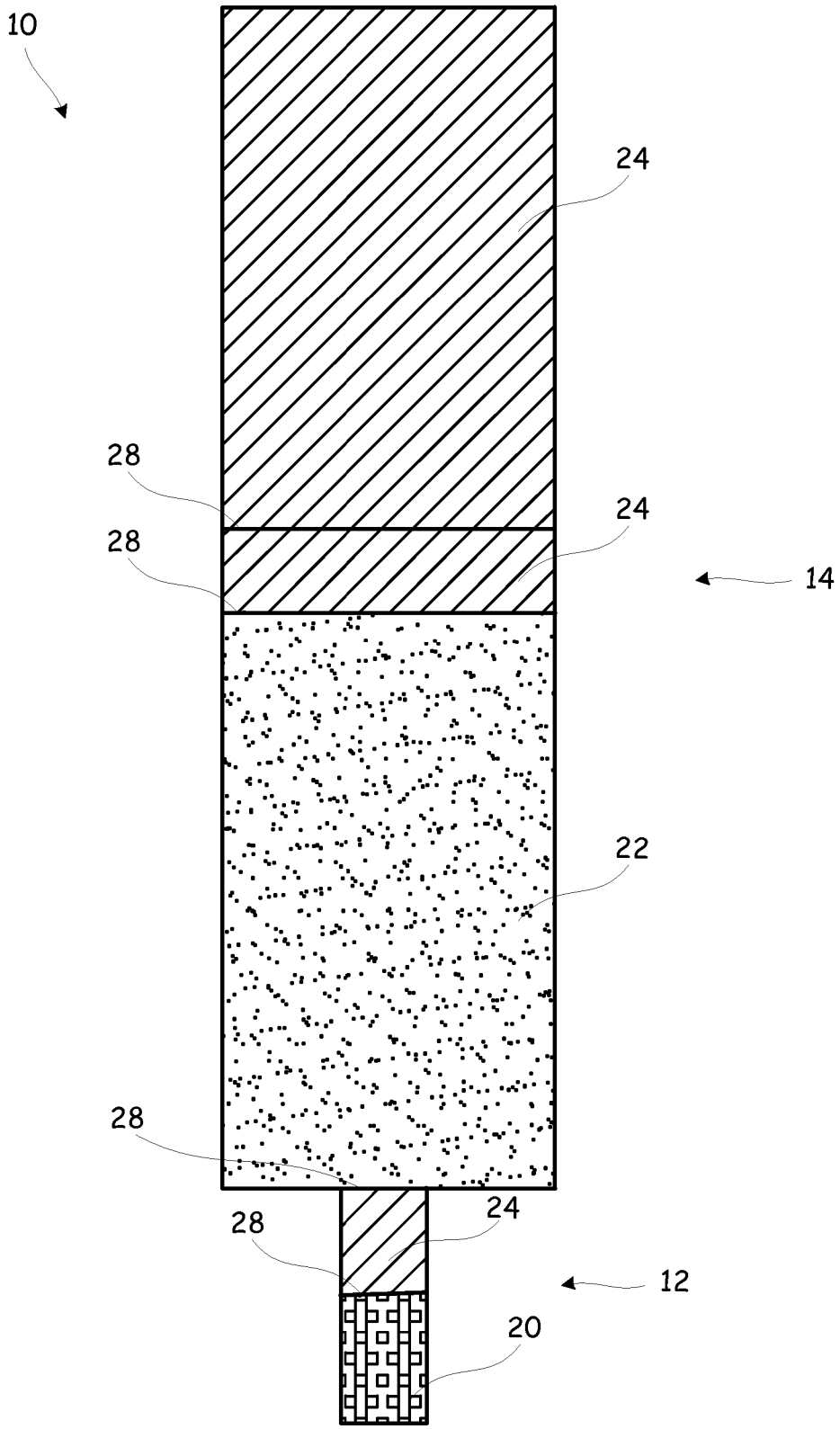
FIG. 2 is an outside planar view of the portable attachment device of the present invention.

Referring now to FIG. 2, an outside perspective view of the portable attachment device 10 is shown. This outside view illustrates the outside surfaces (the surfaces that would be visible to a viewer looking at a wearer of the portable attachment device 10, as shown in FIG. 5) of the portable attachment device 10. The portable attachment device 10 is shown with a narrow attachment end 12, and a wide wrap end 14. This outside view illustrates the outside surfaces of the portable attachment device 10. The wide wrap end 14 includes surfaces of canvas fabric material 24 and a surface of loop fasteners 22. The narrow attachment end 12 includes a surface of canvas fabric material 24 and a surface of hook fasteners 20. Multiple seams 28 are shown illustrating how the various layers of canvas fabric material 24 and hook fasteners 20 are secured together.

Figure 3:
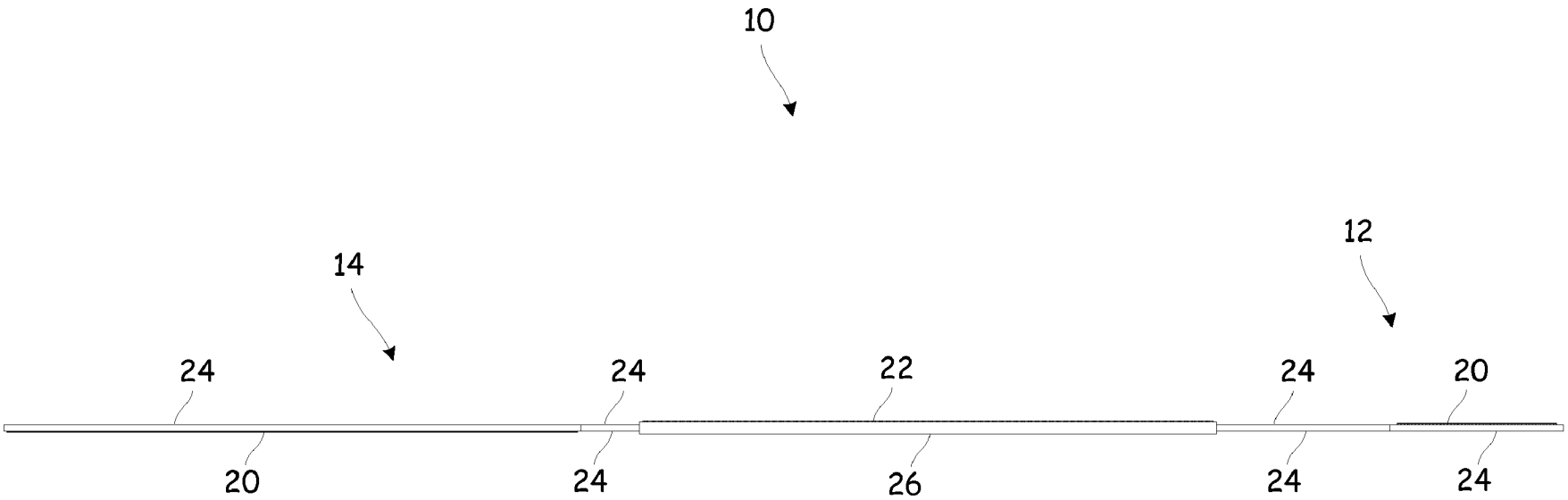
FIG. 3 is a side planar view of the portable attachment device of the present invention.

Referring now to FIG. 3, a side planar view of the portable attachment device 10 is shown. The portable attachment device 10 is shown with a narrow attachment end 12, and a wide wrap end 14. As the portable attachment device 10 is viewed from the side, the references across the top edge represent the inside surfaces, as shown in FIG. 1. The wide wrap end 14 includes surfaces of canvas fabric material 24 and a surface of loop fasteners 22. The narrow attachment end 12 includes a surface of canvas fabric material 24 and a surface of hook fasteners 20.

As the portable attachment device 10 is viewed from the side, the references across the bottom edge represent the outside surfaces, as shown in FIG. 2. The wide wrap end 14 includes a surface of hook fasteners 20, surfaces of canvas fabric material 24, and a thicker portion including a surface of canvas fabric material with padding sewn into it 26. The narrow attachment end 12 includes a surface of canvas fabric material 24.

The portable attachment device 10 is shown with a thickness of approximately one quarter of an inch in the areas without padding or without attachment surfaces, approximately one half inch thick in the areas with and attachment surface, and approximately three-quarters of an inch in the portion of the wide wrap end 14 containing padding. These thicknesses, however, may be varied to provide for varying degrees of padding and comfort. The surface of canvas fabric material with padding sewn into it 26 in the wide wrap end 14 is thicker than the portion of the wide wrap end 14 without the additional padding. The actual padding 27, located between the layers of canvas fabric material is shown in FIG. 1.

The portable attachment device 10 is shown with a height of approximately four and a quarter inches on the wide wrap end 14 and one and a quarter inches on the narrow attachment end 12. The portable attachment device 10 is shown with an overall length of fifty four inches. The length of the wide wrap end 14 is forty two inches and the length of the narrow attachment end 12 is twelve inches. The height and length of the wide wrap end 14 and the narrow attachment end 12 may be varied in order to provide for varying degrees of padding and comfort.

The overall length of the portable attachment device 10 is beneficial in providing not only a wrap around a the calf portion of a wearer's leg on a construction stilt with the padded portion of the wide wrap end 14, but also additional length in the wide wrap end 14 to wrap around the leg again. Depending on the size of the leg of the wearer, this may result in two complete revolutions of the portable attachment device 10 around the wearer's leg. This provides comfort and stability not offered in other construction stilts. Thus, the portable attachment device 10 provides a wrapped layer for padding and comfort and a wrapped layer for security. Such a device prevents slippage and adds additional safety.

Referring now to FIG. 4, a front perspective view of the portable attachment device 10 is shown. The portable attachment device 10 is shown with a narrow attachment end 12, and a wide wrap end 14. The wide wrap end 14 includes an outside surface of canvas fabric material 24 and a surface of loop fasteners 22. The canvas fabric material 24 side of the narrow attachment end 12 is shown wrapped around the stilt frame 30 and attached to the surface of loop fasteners 22 on the wide wrap end 14. The narrow attachment end 12 is fed through a space between the stilt frame 30 and the leg band 32. Hook fasteners 20 on the narrow attachment end 12, as shown previously in FIG. 2, are attached to the loop fasteners 22 located on the wide wrap end 14. This holds the portable attachment device 10 securely to the construction stilt frame 30.

The stilt frame 30 and the leg band 32 are well known in the construction industry as key components of construction stilts. The portable attachment device 10 is designed to work with various items, including all varieties of construction stilts. The portable attachment device 10 is easily interchangeable amongst different sets of construction stilts. Thus it is far more portable, secure, and comfortable than the narrow, basic leather or nylon straps that normally accompany construction stilts. Furthermore, the portable attachment device 10 is not overly burdensome or time consuming to use since there are no buckles to thread or adjust as there are on most construction stilts.

Referring now to FIG. 5, a front perspective view of the portable attachment device 10 is shown. The calf portion of the leg 40 of the wearer of the portable attachment device 10 is shown placed in the stilt frame 30. The narrow attachment end 12 attaches to the stilt frame 30 and leg band 32, as illustrated previously in FIG. 4. The wide wrap end 14 surrounds the stilt frame 30, leg band 32, and leg 40, securely and comfortably holding the wearer's leg 40 in place. Once wrapped around the stilt frame 30 and the leg 40, only the surface of canvas fabric material 24 is exposed.

Although the present invention has been illustrated and described with reference to preferred embodiments and examples thereof, it will be readily apparent to those of ordinary skill in the art that other embodiments and examples may perform similar functions and/or achieve similar results. All such equivalent embodiments and examples are within the spirit and scope of the invention and are intended to be covered by the following claims.

What is claimed is:

1. A construction stilt system having a portable attachment device comprising:

a construction stilt, for use on a leg of the wearer;

a flexible fabric material device comprising:

a narrow attachment end; and a wide wrap end, wherein the narrow attachment end and the wide wrap end are at opposite ends of the flexible fabric material device;

a fastening means on the narrow attachment end;

a fastening means on the wide wrap end;

padding, located within the wide wrap end;

wherein the portable attachment device is attachable to the construction stilt by wrapping the narrow attachment end of the flexible fabric material device around a portion of the construction stilt and attaching the narrow attachment end to a portion of the wide wrap end with the fastening means on the narrow attachment end, securing the portable attachment device to the construction stilt, and wherein the construction stilt and the portable attachment device are then attachable to a leg of the wearer by wrapping the wide wrap end of the attachment device around the leg of the wearer, securing the portable attachment device and the construction stilt to the leg of the wearer of the construction stilt with the fastening means on the wide wrap end.

2. The construction stilt system having a portable attachment device of claim 1, wherein the narrow attachment end is further comprised of:

a surface of canvas fabric material, and a surface of hook fasteners.

3. The construction stilt system having a portable attachment device of claim 1, wherein the wide wrap end is further comprised of:

a surface of canvas fabric material, a surface of hook fasteners, and a surface of loop fasteners.

4. The construction stilt system having a portable attachment device of claim 1, wherein the fastening means on the narrow attachment end comprises hook fasteners.

5. The construction stilt system having a portable attachment device of claim 1, wherein the fastening means on the wide wrap end comprises hook fasteners and loop fasteners.

6. A method for manufacturing a construction stilt system having a portable attachment device, comprising the steps of:

cutting a first piece of flexible fabric material into a shape having a narrow attachment end and a wide wrap end;

cutting a second piece of flexible fabric material into a shape having a narrow attachment end and a wide wrap end;

placing padding between portions of two stacked layers of the first piece of flexible fabric material and the second piece of flexible fabric material at the wide wrap end;

securing the stacked layers of flexible fabric material and padding together;

securing a fastening means to the narrow attachment end;

securing a fastening means to the wide wrap end; and attaching the portable attachment device to a construction stilt by wrapping the narrow attachment end of the flexible fabric material around a portion of the construction stilt and attaching the narrow attachment end to a portion of the wide wrap end with the fastening means on the narrow attachment end, securing the portable attachment device to the first item.

7. The method of claim 6, wherein the securing the stacked layers and padding together is by sewing the layers together.

8. The method of claim 6, wherein the flexible fabric material is nylon fabric.

9. The method of claim 6, wherein the flexible fabric material is canvas fabric.

10. The method of claim 6, wherein the fastening means to the narrow attachment end and the wide wrap end is hook and loop fasteners, wherein the narrow attachment end is placed around a first item and secured to the wide wrap end, and wherein the wide wrap end is wrapped around a second item and the first item, securely holding the first item and the second item together.

* * * * *